United States Patent [19]

Imai et al.

[11] 4,025,232

[45] May 24, 1977

[54] TURBOMACHINE ROTOR ASSEMBLY

[75] Inventors: Tetsu Imai; Kazuo Ikeuchi, both of Hitachi, Japan

[73] Assignee: Hitachi, Ltd., Japan

[22] Filed: Nov. 20, 1975

[21] Appl. No.: 633,929

Related U.S. Application Data

[63] Continuation-in-part of Ser. No. 524,275, Nov. 15, 1974, abandoned.

[30] Foreign Application Priority Data

Nov. 27, 1973 Japan ..... 48-132187
Nov. 19, 1974 Canada ..... 214074

[52] U.S. Cl. ..... 416/191; 416/195; 416/196 R

[51] Int. Cl.[2] ..... F01D 5/22

[58] Field of Search ..... 416/189–191, 416/195, 196

[56] References Cited

UNITED STATES PATENTS

| | | | |
|---|---|---|---|
| 3,314,652 | 4/1967 | Geberth et al. | 416/196 |
| 3,572,968 | 3/1971 | Musick et al. | 416/191 |
| 3,837,761 | 9/1974 | Brown | 416/191 |

FOREIGN PATENTS OR APPLICATIONS

| | | | |
|---|---|---|---|
| 38,086 | 3/1968 | Japan | 416/191 |

*Primary Examiner*—Everette A. Powell, Jr.
*Attorney, Agent, or Firm*—Craig & Antonelli

[57] ABSTRACT

A turbo machine rotor assembly which includes a turbine wheel having moving blade covers or connecting pieces connected to adjacent moving turbine blades. Each of the moving turbine blades includes a first ledge and second ledge at a leading edge and trailing edge side portions, respectively, of the tip of the blade with the first and second ledge portions extending substantially in tangential directions of the turbine wheel but in opposite directions to each other. One of the first and second ledges is provided with a through hole or aperture extending radially of the turbine wheel. The moving blade cover or connecting piece is provided with a pair of spaced pins receivable in the apertures of the first and second ledges for connecting the first ledge of one moving turbine blade and the second ledge of an adjacent moving turbine blade in such a manner that the upper surface of the cover contacts with the lower surfaces of the first and second ledges. One of the pins is loosely fitted in one aperture and the other pin is provided with a flared head portion for rotatably fixing the connecting piece between adjacent turbine blades. The moving blade cover can bear a large centrifuged force and does not constrain the torsions of the moving turbine blades during the rotation of the turbine wheel.

9 Claims, 4 Drawing Figures

TURBOMACHINE ROTOR ASSEMBLY

CROSS-REFERENCE TO THE RELATED APPLICATION

This is a continuation-in-part application of Ser. No. 524,275, filed Nov. 15, 1974, now abandoned.

BACKGROUND OF THE INVENTION

The present invention relates to a rotor assembly having a turbine wheel, such as, a steam turbine or gas turbine, and more particularly to a construction for attaching a moving blade cover or connecting piece to adjoining turbine blades of the turbine wheel.

Hitherto, the connection between the adjoining moving blades of a turbine wheel, particularly the connection between the long moving blades by a moving blade cover or connecting piece has been made in such a manner that holes are provided in a moving blade at a portion adjacent to the tip and leading edge thereof, and in an adjoining moving blade at a portion adjacent to the tip and trailing edge thereof respectively, and then projections of a moving blade cover formed at opposite ends thereof are inserted into the holes respectively with a projection of the moving blade cover on one side being fixed while the other projection on the other side of the cover is loosely inserted into the holes. However, a disadvantage of such a construction lies in that fact that such construction cannot bear the application of a centrifugal force of a large magnitude to the moving blade covers and, such construction is not satisfactory from the viewpoint of safety.

SUMMARY OF THE INVENTION

Accordingly, it is a principle object of the present invention to provide a device for connecting adjoining moving blades of a turbine wheel which can be used in safety even at high rotational speeds of the turbine wheel.

A further object of the present invention resides in providing a device for connecting adjoining blades which does not constrain the torsion applied to the moving blades but which can bear a large centrifugal force applied thereto when the turbine wheel is in rotation.

Still another object of the present invention resides in providing a device for connecting adjoining blades with a moving blade cover or a connecting member wherein the moving blade cover is supported against a centrifugal force applied thereto at large areas so that the moving blade cover is sufficiently strong and safe and, additionally, serves as a means for preventing increasingly the moving blades from vibrations which are acting on the moving blades in the tangential direction of the turbine wheel.

According to the features of the present invention, there is provided a turbine wheel assembly which includes a device for connecting adjoining blades at their tips to each other. The connecting device is disposed between a first ledge provided at the tip of a moving blade and a second ledge provided at the tip of an adjacent moving blade with the first and second ledges of the respective blades extending substantially in the tangential direction of the turbine wheel and positioned in opposed relation to each other. The first and second ledges are provided with at least one hole or aperture which extend radially of the turbine wheel. The connecting device includes a moving blade cover for connecting the first and second ledges of the adjacent turbine blades. The cover includes at least one pin provided at respective sides thereof which is receivable in the respective holes provided in the first and second ledges. The cover connects adjoining blades in such a manner that one of the pins is loosely received in one hole of one ledge and the other pin is rotatably received in the hole of the other ledge with the upper surface of the cover member contacting the lower surface of the respective ledges.

BRIEF DESCRIPTION OF THE DRAWINGS

These and other objects, features, and advantages of the present invention will become more apparent from the following description when taken in connection with the accompanying drawings which show for the purposes of illustration only one embodiment in accordance with the present invention, and wherein.

DETAILED DESCRIPTION OF THE PREFERRED EMBODIMENT

Figure 1:
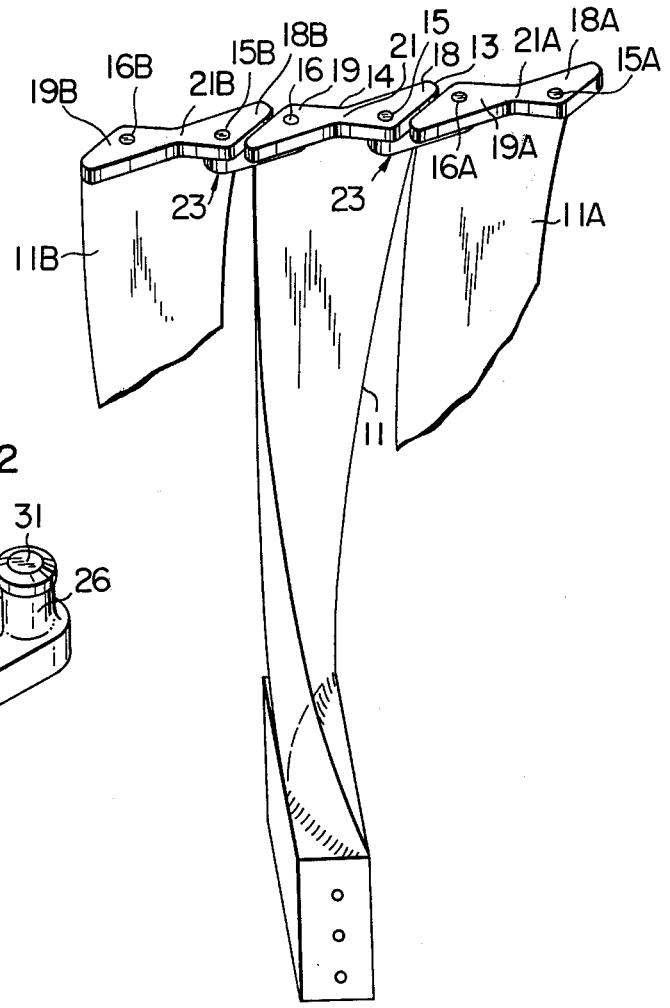
FIG. 1 is a perspective view of a turbine blade construction in accordance with the present invention.

Referring now to the drawings wherein like reference numerals are used throughout the various view to designate like parts, and more particularly to FIG. 1, according to this Figure, a turbine blade 11 is provided having a twist preliminarily formed during the manufacture of the blade. In such a long blade construction, the twist of the blade will tend to be returned under an action of a centrifugal force applied thereon during the operation of the turbine assembly. Thus, the twisted blade will tend to be changed to a straight blade during operation. By virtue of this fact, the tip portion of the blade tends to rotate in the direction of arrows A in FIG. 3.

The moving turbine 11 includes a tip having a leading edge side portion 13 and a trailing edge side portion 14 with first and second ledges 18, 19 provided respectively at the leading edge side portion 13 and trailing edge side portion 14. The first and second ledges 18, 19 extend in opposite directions from that blade 11 and are disposed substantially perpendicular to the plane of the blade 11 so as to extend in the tangential direction of the turbine wheel.

A moving turbine blade 11A is disposed adjacent one side of the turbine blade 11 and it also includes a first ledge 18A and a second ledge 19A at the leading edge and trailing edge side portions, respectively. The first ledge 18 of the turbine blade 11 and the second ledge 19A of the adjacent turbine 11A are positioned in opposing relation to each other.

A further moving turbine blade 11B is disposed adjacent the other side of the turbine blade 11 and is provided with a first ledge 18B and a second ledge 19B at the respective leading edge and trailing edge side portions thereof. The second ledge 19 of the turbine blade 11 and the first ledge of the turbine blade 11B are positioned in opposing relation to each other. While only three moving turbine blades 11–11B are shown in FIG. 1, it is understood that the remaining turbine blades of the turbine wheel assembly are arranged adjacent each other in the same relationship as the turbine blades 11–11B; namely, the first ledge of one blade is disposed adjacent the second ledge of the adjacent turbine blade in the turbine assembly.

Each of the first ledges 18–18B and each of the second ledges 19–19B are provided with through holes or apertures 15–15B, 16–16B, respectively. The apertures are opened vertically of the respective ledges and extend radially of the turbine wheel.

The respective ledges 18–18B, 19–19B are substantially flat and are preferably slightly inclined along the respective ledges with a narrowed portion 21, 21A, 21B joining the respective first and second ledges of the moving turbine blades 11–11B.

Figure 2:
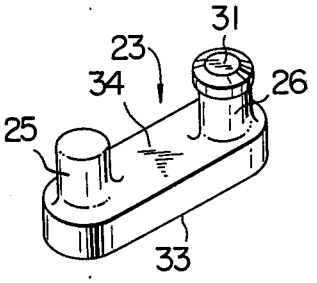
FiG. 2 is a perspective view of a blade cover or moving blade connecting piece in accordance with the present invention.

To connect and space the adjacent blades and to permit a re-storing action of the twisted blade, a moving blade cover or moving blade connecting piece generally designated by the reference numeral 23 is provided. As shown in FIG. 2, the connecting piece 23 includes a flat plate 33 provided with rounded opposite ends having pins 25, 26 integrally formed with the plate 33 adjacent the opposite ends thereof, the pin 26 is longer than the pin 25 so as to permit a flaring or enlarging of the same to form a head portion 31 the purposes of which will be explained more fully hereinafter.

Figure 3:
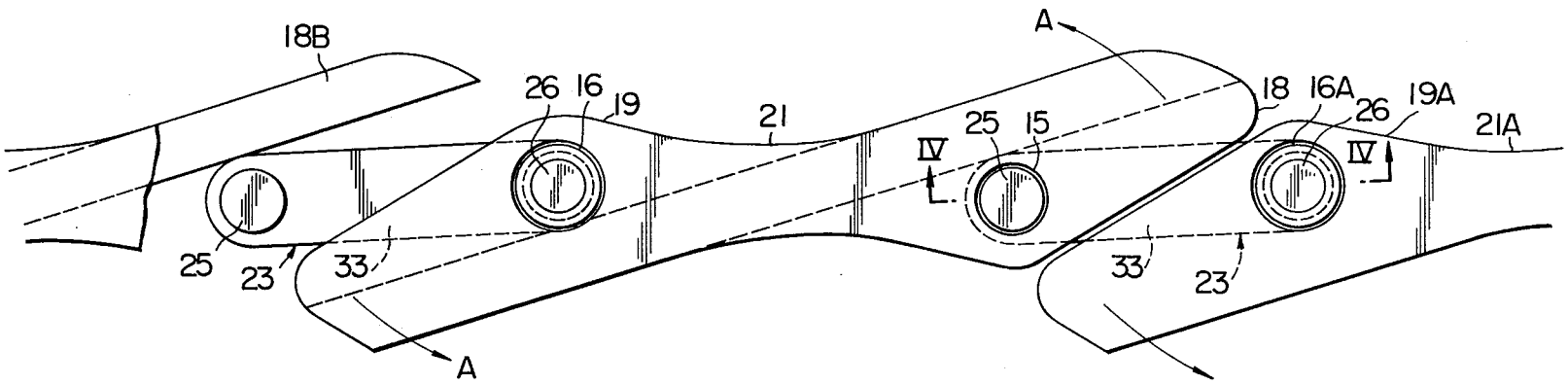
FIG. 3 is a plan view of the tip portion of the turbine blade construction of FIG. 1.
Figure 4:
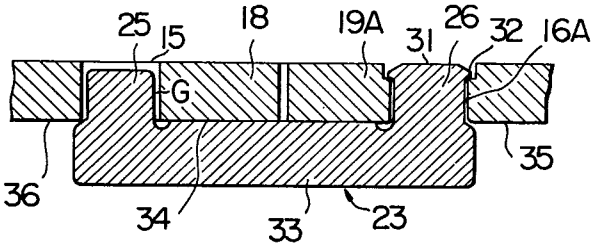
FIG. 4 is a cross-sectional view taken along line IV—IV of FIG. 3.

As shown in FIGS. 3 and 4, the ledges 18 and 19A of the moving turbine blades 11, 11A are arranged so that the adjoining edges of the ledges 18, 19A are contacted with each other or there is provided a much limited clearance between the ledges 18, 19A in the rest condition of the turbine wheel. Likewise, the ledge 19, 18B of the moving turbine blade 11, 11B are arranged in the same manner as the blades 11, 11A.

One of the pins 25 of the connecting piece 23 is inserted in the aperture 15 in the first ledge 18 of the moving blade 11. The longer pin 26 of the connecting piece 23 is inserted in the aperture 16A of the second ledge 19A of the adjacent moving blade 11B. After the inserting of the pin 26 in the aperture 16A, the upper end thereof is calked or turned over within a recess 32 formed in the upper surface of the ledge 19A whereby the connecting piece 23 is rotatably mounted at the ledge 19A with the upper surface 34 of the cover 23 being in contact with the lower surface 35 of the ledge 19A and with the connecting piece 23 itself being adapted for rotation relative to the ledge 19A.

The diameter of the pin 25 is less than the diameter of the aperture or through-hole 15 whereby, upon insertion of the pin 25 in the aperture 15, a gap G (FIG. 4) results between the outer surface of the pin 25 and the inner surface of the aperture 15. As can be seen most clearly in FIG. 4, after insertion of the pin 25 in the hole 16 and the flaring of head portion 31, the upper surface 34 of the connecting piece 23 contacts the lower surface 36 of the ledge 18.

By virtue of the above-described construction, even if a restoring action of the twist of the turbine blade is caused due to centrifugal force, the connecting piece or cover 23 permits a relative rotation for the moving blade. Furthermore, even if the distance between the holes 15, 16A is changed due to the twist action of the moving blade, the restoring action is not limited due to the presence the gap G. Also, there is provided by the above construction a spacing between adjacent moving blades and, furthermore, an attenuation against vibration is realized due to friction between the contact surfaces of the connecting piece and respective ledges thereby resulting in a lashing between the moving blades.

While only the interconnection of blades 11, 11A has been described in detail, it is understood that the same interconnection is provided between the turbine blades 11 and 11B and also between the remaining blades of the turbine wheel assembly. Specifically, as shown in FIG. 3, the pin 26 of the connecting piece 23 is received in the hole or aperture 16 of the ledge 19 of blade 11 and flared into a head portion 31 in a recess provided in the upper surface of the ledge 19 while the pin 25 is received in a hole or aperture 15B provided in the edge 18B of the moving blade 11B.

In place of a through hole or aperture, it may be possible to provide a recess in the ledge for receiving the shorter pin 25 of the connecting piece 23. In such a construction the length of the pin 25 of the connecting piece may be reduced.

If the moving blades 11, 11A, and 11B are connected to each other by means of the connecting piece 23 in the manner described hereinabove, then the moving blade 11, 11A, or 11B is free to rotate about either of the pins 25, 26 which serves as a hinge when torsion is applied thereto in rotation. The centrifugal force applied by the connecting piece 23 is received over a relatively wide area of the ledges 18–18B, 19–19B of the respective moving blade whereby vibration of the moving blade in the tangential direction is suppressed.

According to the present invention, integrally formed first and second ledges are provided on the tip of respective moving blades in a manner to cover the leading-edge side portion and the trailing-edge side portion and to extend sideways of the blade at a right angle and perpendicular to the blade and a moving blade connecting piece or cover having at least two pins is used for connecting adjoining moving blades. With the aid of the moving-blade connecting piece, the respective moving blades are free to rotate upon application of torsion during the rotation of the turbine wheel and a suppression of the vibration of the moving blade in the tangential direction is realized.

The centrifugal force applied by the moving blade connecting piece is received by the respective ledges which have a relatively wide area thereby reducing the risk of breaking of the respective connecting pins. The strength of the ledge is sufficient for preventing the slipping off of the pin; therefore, the present invention provides a turbine wheel assembly which is greatly improved from the viewpoint of safety.

The moving blade connecting piece and its pins are formed integrally so that a width of the respective ledge is reduced and, also, the assembly and machining processes required for the connecting piece are facilitated. Additionally, if a precise casting is employed for the manufacture of the moving-blade connecting piece, the numbers of manufacturing steps will be greatly reduced.

While we have shown and described only one embodiment in accordance with the present invention, it is understood that the same is not limited thereto but is susceptable of numerous changes and modifications as known to those skilled in the art, and we therefore do not wish to be limited to the details shown and described herein but intend to cover all such changes and modifications as are encompassed by the scope of the appended claims.

We claim:

1. A rotor arrangement comprising: a plurality of rotor blades arranged adjacent to each other, each of said rotor blades including a tip portion, a first ledge provided on each of said rotor blades at said tip portion, a second ledge provided on each of said rotor blades at said tip portion, said first and second ledges on each of said rotor blades extending outwardly in opposite directions from respective sides of said rotor blades, each of said first and second ledges having an upper surface defining the most external periphery of the rotor arrangement and a lower surface facing the rotor blades, means arranged between adjacent ledges for connecting adjacent rotor blades to each other so as to permit a relative rotation of the connected rotor blades with respect to each other during an operation of the rotor arrangement, said connecting means including a plurality of individual flat plates with a single flat plate extending between adjacent ledges of adjacent rotor blades, at least two spaced pin means provided on a surface of each of said plates facing the lower surface of the ledges, and aperture means provided in each of said first and second ledges for receiving said pin means of a respective plate, said aperture means extending substantially radially of the respective rotor blades, one of said pin means of a plate being rotatably mounted in one aperture means of one ledge of a rotor blade and the other pin means of said plate being loosely fitted in an aperture means in one ledge of an adjacent rotor blade with the surface of the plate upon which said pin means are provided being maintained in contact with the lower surface of each of the adjacent ledges.

2. An arrangement according to claim 1, wherein each of said rotor blades includes a leading edge and a trailing edge, and wherein adjacent ledges on adjacent rotor blades project from the leading edge of one rotor blade and from the trailing edge of an adjacent rotor blade toward each other.

3. An arrangement according to claim 1, wherein one of said pin means on each of said plates has an axial length which is greater than the axial length of the other of said pin means, and wherein the longer of said pin means of each of said plates is flared after insertion into the respective aperture means so as to provide a head portion on the respective pin means to retain said plates to adjacent ledges.

4. A rotor arrangement comprising: a plurality of rotor blades arranged adjacent to each other, each of said rotor blades including a tip portion, a first ledge provided on each of said rotor blades at said tip portion, a second ledge provided on each of said rotor blades at said tip portion, said first and second ledges on each of said rotor blades extending outwardly in opposite directions from respective sides of said rotor blades, a plurality of means for connecting adjacent rotor blades to each other, each of said connecting means including a plate means extending between adjacent ledges of adjacent rotor blades, at least two spaced pin means provided on one surface of said plate means, and aperture means provided in each of said first and second ledges for receiving said pin means of said connecting means, said aperture means extending substantially radially of the respective rotor blades, one of said pin means being rotatably fastened in one aperture means of one ledge of a rotor blade and the other pin means of said connecting means being loosely fitted in one ledge of an adjacent rotor blade whereby the surface upon which said pin means are provided is maintained in contact with a lower surface of each of the adjacent ledges, and wherein adjacent ledges of adjacent rotor blades are arranged in abutting relationship so as to form an outer cylindrical surface of the most external periphery of the rotor arrangement.

5. An arrangement according to claim 1, wherein a predetermined gap is provided between an outer surface of each of the loosely fitted pin means and the respective aperture means in which said loosely fitted pin means is received, said gap having a dimension sufficient to permit relative rotation of the plates with respect to said rotor blades.

6. An arrangement according to claim 1, wherein the respective first and second ledges of each of said rotor blades have a substantially flat upper surface.

7. An arrangement according to claim 1, wherein each of said rotor blades includes a leading edge and a trailing edge, said first ledge of each of said rotor blades being provided on said leading edge of the respective rotor blade and said second ledge of each of said rotor blades being provided on a trailing edge of the respective rotor blade, and a narrowed portion provided on each of said rotor blades for joining said first and second ledges of each of said blades to each other.

8. An arrangement according to claim 1, wherein the first and second ledges of each of said rotor blades extends substantially in a tangential direction of the rotor arrangement.

9. An arrangement according to claim 1, wherein said pin means of each of said connecting means are integrally formed with said plate means.

* * * * *